United States Patent [19]

Aberer

[11] 4,157,130

[45] Jun. 5, 1979

[54] FIRE LADDER AND METHOD OF CONSTRUCTING SAME

[75] Inventor: James B. Aberer, Lake Winnebago, Mo.

[73] Assignee: Rival Manufacturing Company, Kansas City, Mo.

[21] Appl. No.: 889,629

[22] Filed: Mar. 24, 1978

[51] Int. Cl.[2] ..... E06C 1/56; E06C 1/36

[52] U.S. Cl. ..... 182/198; 182/156; 182/206

[58] Field of Search ..... 182/196, 197, 198, 199, 182/228, 206, 156; 135/15 PQ

[56] References Cited

U.S. PATENT DOCUMENTS

| | | | |
|---|---|---|---|
| 2,333,498 | 11/1943 | Westling | 182/198 |
| 2,518,839 | 8/1950 | Thonney | 182/196 |
| 2,887,261 | 5/1959 | McGuiire | 182/198 |
| 2,960,181 | 11/1960 | Bufogle | 182/176 |
| 3,349,870 | 10/1967 | Lieblein | 182/228 |
| 3,448,748 | 6/1969 | Walrave | 135/15 PQ |
| 3,727,724 | 4/1973 | Gilbert | 182/206 |
| 3,834,492 | 9/1974 | Ronk | 182/206 |

FOREIGN PATENT DOCUMENTS

| | | | |
|---|---|---|---|
| 145522 | 11/1903 | Fed. Rep. of Germany | 182/196 |
| 273558 | 4/1930 | Italy | 182/196 |

*Primary Examiner*—Reinaldo P. Machado

*Attorney, Agent, or Firm*—Lowe, Kokjer, Kircher, Wharton & Bowman

[57] ABSTRACT

A fire ladder includes as opposite sides a pair of elongate flexible cables in the form of interwoven strands of wire. Hollow tubes flattened and scored on their upper surfaces extend rigidly between the cables to provide the ladder rungs. The rungs have initially open ends into which looped portions of the cables are inserted. One side wall of the rung is then crimped inwardly and pressed against the opposite wall to firmly clamp the cable within the rung. Hook-like arms secured to the ends of the cables serve to suspend the ladder from a window sill and may be folded by means of a hinge structure to a collapsed storage position occupying little space. A spring located within the hinge arms maintains the hook-like support arms spaced apart during use, while stops prevent the arms from pivoting excessively.

1 Claim, 6 Drawing Figures

FIRE LADDER AND METHOD OF CONSTRUCTING SAME

BACKGROUND AND SUMMARY OF THE INVENTION

This invention relates to an improved fire ladder and also to a method of constructing such a ladder.

Fire ladders of flexible construction have been developed in order to provide for the escape of persons from the upper stories of buildings during fires. Typically, these ladders include a pair of chains between which the rungs extend. Hooks or similar members are provided on the upper ends of the chains for attachment to a window sill or the like in order to suspend the ladder therefrom.

The flexible nature of the ladder permits it to be collapsed and stored in a box or the like. In the event of a fire, the hooks are attached to the window sill and the chains are thrown out of the window so that escape may be made down the ladder.

A serious problem with existing ladders of this type is the tendency of the chains to become twisted and tangled with one another and/or with the rungs when thrown out the window. Manifestly, such difficulties seriously compound the dangers in what is already an emergency situation. Chains are also relatively expensive and are susceptible to breaking and other damages and they take up a considerable amount of space so that storage of the ladder requires a large container. Connecting the rungs to the chains in a suitable manner also presents a problem in that the connections must be secure in order to avoid unsafe conditions, while they must at the same time be relatively simple and economical for practical reasons. In existing ladders, welding and other conventional types of connections are used.

The manner in which existing ladders are suspended from a building support such as a window sill has been generally unsatisfactory in that stability is lacking and the ladder sometimes is able to work itself free of the sill. It is desirable for the hook arms used to suspend the ladder to be connected to one another so that their spacing does not change to an excessive extent during use. Likewise, it is desirable for the arms to be foldable against one another for convenient storage. The flexible ladders that have been proposed have not been capable of convenient folding while at the same time adequately resisting collapse during use. Further, the scissors-like hinges that have been used to connect the hook arms present a serious safety hazard since they collapse when significant weight is placed on them, as when a foot is inadvertently placed on the hinge.

The present invention provides an improved ladder which is characterized by strong, flexible wire cables forming the opposite ladder sides. The cables are bent into loops and the loops are inserted into open ends of tubes that serve as the ladder rungs. The ends of each tube are forcibly collapsed such that one tube wall is flattened against the other in a manner to firmly clamp the cables within the ends of the tubes. This manner of construction provides a ladder which is not susceptible to becoming tangled since no chain links or other like structures are presented. Further, the rungs are mounted by means of a simple method which may be carried out with convention equipment and which results in secure connections between the rungs and cables. The upper surface of each rung is flattened and scored to conveniently receive the feet, while a unique hinge mechanism is provided to bias the support arms toward a spread position while permitting them to be conveniently folded to a collapsed storage position.

It is an important object of this invention to provide a ladder having flexible metal cables as opposite sides. The wire "rope" structure of the cables provides them with more than adequate strength, while avoiding the problems associated with chains such as the tendency of chain links to tangle with one another and with the rungs and to catch on snags and the like.

Another object of the invention is to provide a ladder of the character described wherein the rungs are secured to the cables in a unique fashion which enhances the overall strength of the ladder.

A further object of the invention is to provide a ladder of the character described which is simple and economical to construct and yet improved as to its safety and strength characteristics in comparison to existing ladders.

Yet another object of the invention is to provide a ladder of the character described wherein the rungs are constructed in a manner to readily accomodate the feet without slippage.

Still another object of the invention is to provide a ladder of the character described having support arms which are coupled together by a unique hinge arrangement that firmly maintains the arms in a spread apart position during use, while permitting the arms to be quickly and easily folded to a collapsed position for convenient storage.

An additional object of the invention is to provide a unique method of constructing a fire ladder which may be carried out quickly, easily and economically.

A still further object of the invention is to provide a method of the character described which results in secure connections of the ladder rungs to the metal cables which form the sides of the ladder. In addition, the necessity of welding the rungs is eliminated, as are the problems associated with welding and other conventional fastening means.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith and in which like reference numerals are employed to indicate like parts in the various views.

Figure 1:
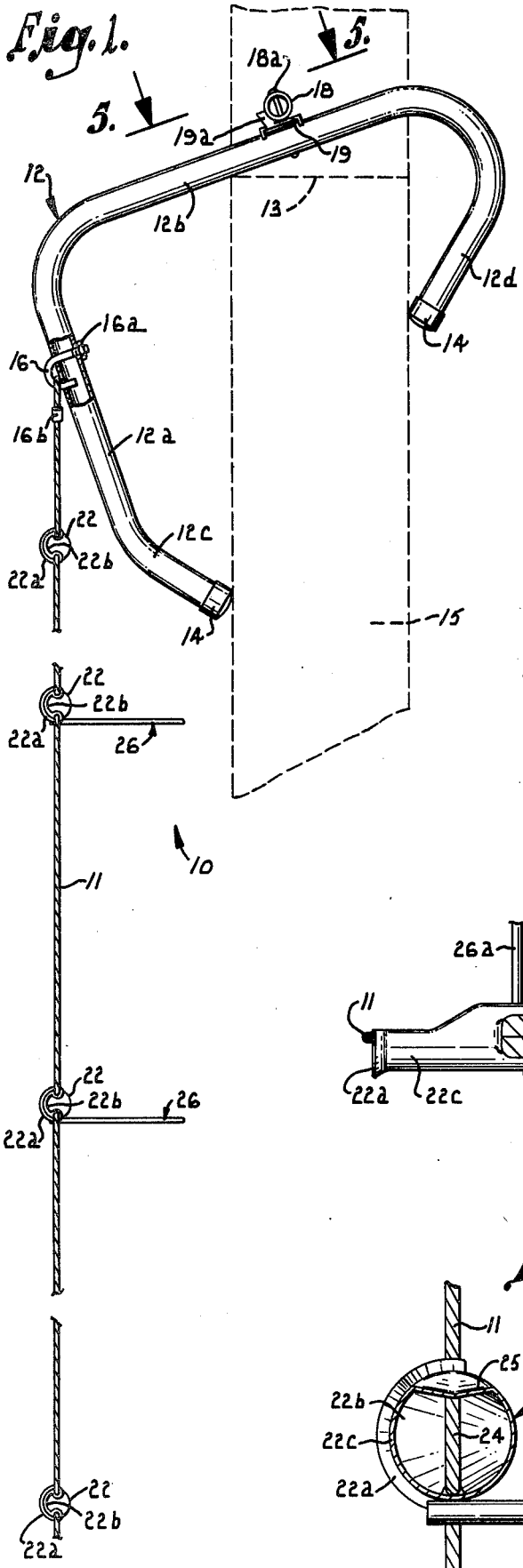
FIG. 1 is a side elevational view of a fire ladder constructed in accordance with a preferred embodiment of the present invention, and showing the ladder suspended from a window sill illustrated in broken lines, with portions broken away for illustrative purposes.
Figure 2:
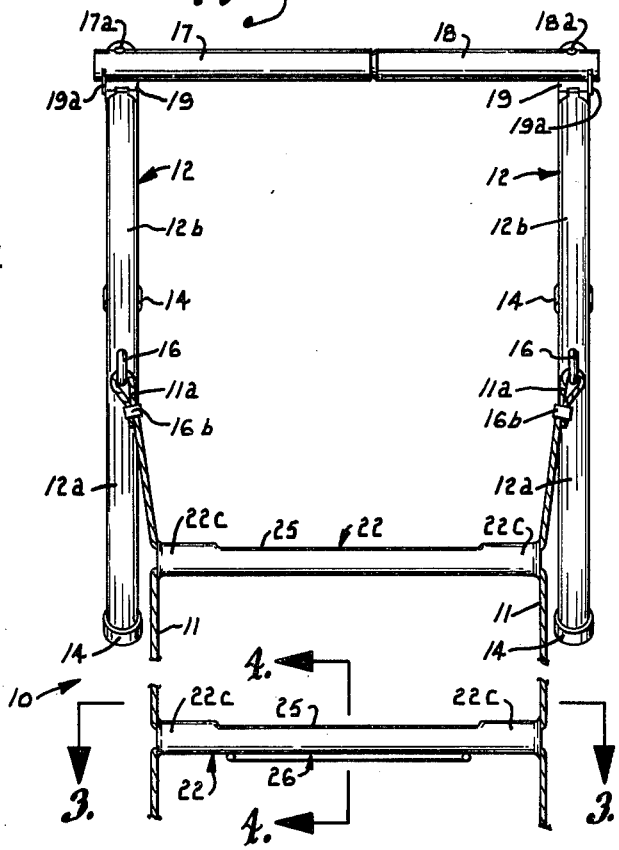
FIG. 2 is a front elevational view of the upper portion of the ladder shown in FIG. 1.

Referring now to the drawings in greater detail, numeral 10 generally designates a ladder constructed in accordance with the present invention. The opposite sides of the ladder are formed by a pair of elongate flexible cables 11 which are each constructed of thin strands of interwoven metal wire. The wire strands are arranged in bunches or groups which are wound together in spiral fashion to provide a wide "rope" construction. The cables 11 have more than adequate strength to accomodate the loads normally applied to the ladder, and they may be of any desired length.

The upper end of each cable 11 is connected with an arm member 12 in the form of a hollow metal tube bent in several places in compound fashion. Each arm 12 has leg portions **12*a* and 12*b* joining one another through a smooth right angle bend. The cable is connected to leg 12*a* in a manner that will be detailed. The lower end of leg portion 12*a* is bent inwardly to provide a short stub 12*c*. Another relatively short stub 12*d* is turned downwardly from the inner end of leg portion 12*b* to provide a hook-like structure that may be hooked over a window sill 13 in the manner shown in FIG. 1. The stubs 12*c* and 12*d* are each provided on their free ends with rubber cushions or pads 14 for engagement with the wall 15** of a building.

The hook-like support arms 12 serve to suspend ladder 10 from window sill 13 or another supporting structure. Cables 11 are connected to portions **12*a* of the respective arms at locations which cause the cables to be spaced well outwardly from the wall 15. The connections of arms 12 to cables 11 are effected by J-bolts 16 which are secured to legs 12*a* by nuts 16*a*. Loops 11*a* which are formed on the upper ends of cables 11 are interlocked with the respective J-bolts 16 in order to securely connect the cables with the support arms. A ferrule 16*b* is employed to secure the loop 11a** of each cable.

Figure 5:
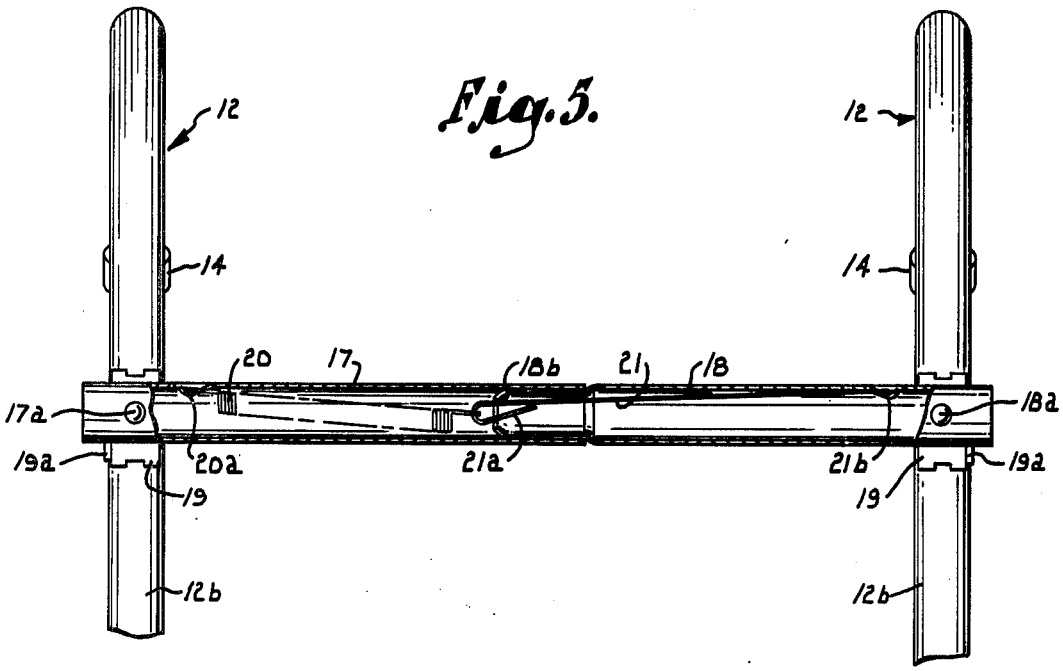
FIG. 5 is an enlarged fragmentary view taken generally along line 5—5 of FIG. 1 in the direction of the arrows, with a portion broken away to illustrate the internal details.

Arms 12 are coupled together for folding movement between a functional position wherein the arms are spaced apart (FIG. 5) and a collapsed storage position wherein the arms lie against one another (FIG. 6) and thus occupy as little space as possible. Coupling of the arms is accomplished by a hinge member which is formed by a pair of cooperating hinge arms 17 and 18 coupled together end to end. Referring particularly to FIG. 5, each arm 17 and 18 is a hollow metal tube pivoted at one end to a bracket 19 mounted on the upper leg portion **12*b* of each arm 12. Respective pivot pins 17*a* and 18*a* couple arms 17 and 18 to the corresponding brackets 19. Outward pivoting of the lower portion of each arm 12 relative to the hinge member is limited by a stop 19*a* which projects outwardly from each bracket 19 at a location to engage the hinge arms 17 and 18. Stops 19*a* prevent arms 12 from pivoting beyond the functional position in which arms 12** are oriented in vertical planes parallel to one another.

In the functional position (FIG. 5), arms 17 and 18 cooperate to provide a straight hinge member that extends rigidly between arms 12. The end portion **18*b* of arm 18 is reduced slightly in diameter so that it fits rather closely in the adjacent end of arm 17**, thereby providing assistance in maintaining the hinge arms in their straight functional position.

Arms 17 and 18 are urged to remain in the straight position by a tension spring 20 having one end hooked on a tab **20*a* which is punched inwardly from the wall of arm 17 near its outer end. Spring 20 extends within arm 17 and has its opposite end hooked on a loop 21*a* formed on one end of a wire bail 21. The bail 21 extends within arm 18 and has its opposite end hooked on a tab 21*b* punched inwardly from the wall of arm 18 near the outer end thereof. Spring 20 and bail 21 are hooked together at a location slightly outside of end 18*b* of arm 18. It is thus apparent that spring 20 acts to pull arms 17 and 18** toward one another and thereby yieldably biases the hinge arms toward the straight condition.

Figure 6:
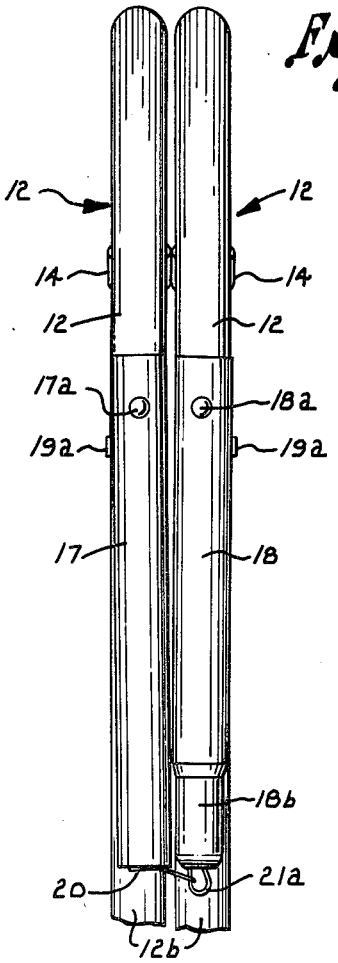
FIG. 6 is a fragmentary view similar to that of FIG. 5 but showing the support arms folded to the collapsed storage position.

Arms 17 and 18 may be folded to the collapsed position shown in FIG. 6 when the ladder is to be stored. To accomplish such folding, arms 17 and 18 are initially pulled axially apart to separate their ends, and they are then folded about the hinge axis provided by the connection between spring 20 and bail 21 until the hinge arms lie against one another, as shown in FIG. 6. The support arms 12 are pivoted about pins **17*a* and 18*a* until they also are disposed against and parallel to one another. Stops 19*a* contact arms 17 and 18 to prevent them from pivoting beyond the storage position. Although spring 20 is stretched somewhat, the spring force acts upwardly on the lower end of arm 17 and the ladder is relatively stable when in its storage position, wherein arms 12, 17 and 18** are arranged in a substantially flat condition occupying a minimum amount of space.

The ladder includes a number of rigid parallel rungs 22 which extend between cables 11 and which are rigidly connected thereto. Each rung 22 is preferably a hollow cylindrical metal tube which is initially open at both ends with the ends being funnel shaped as indicated at **22*a*. The rungs 22 are each connected to both cables 11 in identical fashion; therefore the connection of one end of only one rung will be described, it being understood that the remaining rungs are connected to the cables 11** in the same manner.

Figure 3:
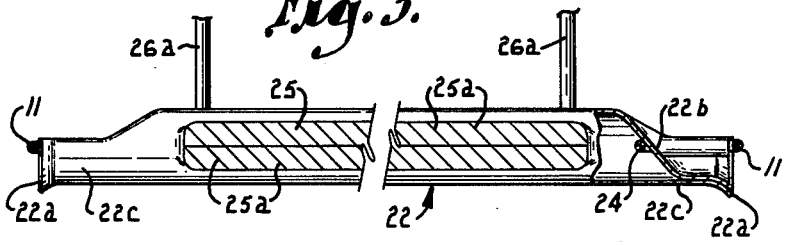
FIG. 3 is a sectional view on an enlarged scale taken generally along line 3—3 of FIG. 2 in the direction of the arrows.
Figure 4:
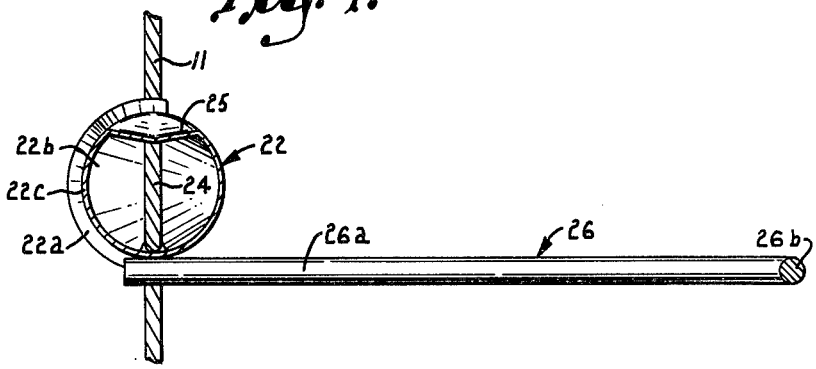
FIG. 4 is a fragmentary sectional view on an enlarged scale taken generally along line 4—4 of FIG. 2 in the direction of the arrows.

Each cable 11 is bent or doubled over in looped fashion to provide a plurality of generally U-shaped loops 24(FIG. 3) which are spaced uniformly along the length of each cable. Each loop 24 is inserted into the open end of the corresponding rung between the curved side wall portions **22*b* and 22*c* of rung 22. The upper and lower legs of loop 24 extend along the internal surfaces of the upper and lower wall portions of the rung. After insertion of the cable loop, wall 22*b* is forcibly pressed or crimped inwardly in the area within the loop until it is pressed against the opposite side wall 22*a* in the manner best shown in FIG. 3. This crimping or deforming operation may be effected with a conventional press machine having a suitably shaped punch head that results in loop 24 being tightly pinched by the metal surrounding walls 22*b* and 22*c*. The cable loop 24 is thus rigidly clamped within the end of rung 22** to securely connect the rung to the cable.

The opposite end of rung 22 is connected to the other cable 11 in the same fashion, and the remaining rungs are likewise connected to extend between the cables at the desired locations. Although it is contemplated that both of the side walls **22*b* and 22*c* may be crimped inwardly in a manner to flatten them against one another and against the loop 24 of the cable, this type of crimping procedure is normally more complex than is a procedure involving deformation of only one of the walls. Accordingly, the described method that entails deformation of only wall 22*b*** is preferred even though the alternative manner of crimping of flattening both walls against the cable is within the scope of the invention.

The upper foot receiving surface 25 of each rung 22 is flattened to facilitate receipt of the foot and prevent slippage. In addition, to guard against slippage and provide a gripping area, surface 25 is scored by score lines 25*a* which are formed therein.

The ladder 10 is normally collapsed and stored in a box or similar container, which can be relatively small due to the small size of the ladder in its stored position. In the event of a fire, the ladder is removed from the box and the hinge arms 17 and 18 are unfolded to the straight, functional position (FIG. 5) wherein arms 12 are securely held apart from and parallel to one another in vertical planes. The hooks provided on the upper portions of arms 12 are hooked over the window sill 13, with portions 12*b* spanning the sill and stubs 12*c* and 12*d* engaging the opposite wall surfaces to stabilize the ladder. The cables 11 and rungs 22 are then thrown out of the window such that the cables are suspended in the manner illustrated in FIG. 1. The wickets 26 keep the ladder spaced away from the building far enough to enable the user to easily walk down the rungs.

It is pointed out that any tendency for arms 12 to spread apart excessively when loaded is firmly resisted by the action of spring 20. Further, the bottom portions of arms 12 are not able to pivot outwardly to an excessive extent due to the stops 19*a*. As a result, arms 12 are securely held in the functional position during use and are able to resist any forces tending to displace them, while the hinge arrangement at the same time permits quick and easy folding of the arms to their storage position.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a ladder having a pair of flexible opposite sides and a plurality of rigid rungs extending between said sides, the combination therewith of:

a pair of arm members connected with the respective sides and formed to engage a support member in a manner to suspend said sides in downward extension therefrom;

a hinge member extending between said arm members and coupling same together for folding movement between a first position wherein said arm members are spaced apart to engage the support member, and a second position wherein said arm members are disposed in close proximity to one another for storage;

wherein said hinge member includes said hinge member having a pair of hinge arms pivotally coupled with the respective arm members and coupled generally end to end with one another, said hinge arms being foldable about their adjoining ends to move said arm members between said first and second position;

means for urging said hinge arms to a position wherein said hinge arms form a substantially straight structure extending between said arm members; and wherein said hinge arms are substantially hollow and said urging means comprises a spring coupled with each hinge arm internally thereof and acting to pull said hinge arms toward one another in a manner to yieldably retain said hinge arms in the substantially straight position.

* * * * *